United States Patent [19]

Kato

[11] Patent Number: 4,842,180

[45] Date of Patent: Jun. 27, 1989

[54] ROLL FEED APPARATUS

[75] Inventor: Heizaburou Kato, Shizuoka, Japan

[73] Assignee: Sankyo Manufacturing Co., Ltd., Tokyo, Japan

[21] Appl. No.: 161,818

[22] Filed: Feb. 29, 1988

[30] Foreign Application Priority Data

Dec. 25, 1987 [JP] Japan ..... 62-328839

[51] Int. Cl.[4] ..... B65H 20/00

[52] U.S. Cl. ..... 226/176; 226/190

[58] Field of Search ..... 226/21-23, 226/176, 177, 180, 190

[56] References Cited

U.S. PATENT DOCUMENTS

| | | | |
|---|---|---|---|
| 3,470,592 | 10/1969 | Robertson | 226/180 X |
| 3,958,736 | 5/1976 | Pounds | 226/21 X |
| 3,977,589 | 8/1976 | Gentile | 226/180 |
| 4,552,295 | 11/1985 | Smith et al. | 226/180 |

*Primary Examiner*—Daniel P. Stodola

*Attorney, Agent, or Firm*—Pollock, Vande Sande & Priddy

[57] ABSTRACT

A roll feed apparatus for intermittently and unidirectionally feeding a sheet material has a first roll fixedly carried by a first roll shaft on a first axis, and a second roll carried by a second roll shaft on a second axis. The rolls cooperate in clamping and feeding sheet material therebetween. A turning shaft, rotatable by an operation lever, includes a first shaft portion on a third axis and second shaft portions on a fourth axis on both axial ends of the first shaft portion, rotatably supported by a housing through self-centering bearings. A pivotable member rotatably supports portions of the first roll shaft on both sides of the first roll. The pivotable member pivotally supported by the first shaft portion of the turning shaft moves the first roll towards and away from the second roll. The third axis extends in parallel with the first axis and is laterally spaced from the first roll. The fourth axis crosses the third axis at a predetermined small angle. The crossing point of third and fourth axes is positioned on or in the vicinity of a straight line which passes an axial mid-portion of the first roll and extends perpendicular to the first axis.

1 Claim, 3 Drawing Sheets

ROLL FEED APPARATUS

BACKGROUND OF THE INVENTION

1. Field of the Invention:

The present invention relates to a roll feed apparatus which is adapted for intermittently feeding a sheet material into an industrial machine such as a press intermittently by a predetermined length of feed.

2. Description of the Related Arts:

A known roll feed apparatus will be described with reference to FIGS. 5 and 6. The roll feed apparatus has a first roll 103 and a second roll 104 which are fixed to a first roll shaft 101 and a second roll shaft 102, respectively. In operation, a sheet material P pinched between these rolls 103 and 104 is fed in a direction B when the rolls rotate in the direction of arrows A. The first roll shaft 101 is supported at its portions 101*a*, 101*b* on both sides of the first roll 103 by a pivotable member 105 through respective bearings 106*a*, 106*b*. Trunnions 105*a*, 105*b* are projected laterally from both sides of the pivoted end (left end as viewed in FIGS. 5 and 6) of the pivotable member 105. These trunnions are rotatably supported by the housing 109 through self-centering bearings 107*a*, 107*b* and eccentric flanges 108*a*, 108*b*. A threaded rod 110 is rotatably connected to the right end of the pivotable member 105 by means of a pin 113. A nut 111 is screwed to the end of the threaded rod 110. The free right end of the pivotable member 105 is always urged downward by means of a spring 114.

The eccentric flanges 108*a*, 108*b* have inner peripheral surfaces 108*a*', 108*b*' which are concentric with the common axis 105' of the trunnions 105*a*, 105*b* and outer peripheral surfaces 108*a*'', 108*b*'' the axis of which is offset by an amount e from the axis of the inner peripheral surfaces mentioned above. The inner peripheral surfaces 108*a*', 108*b*' fit on the self-centering bearings 107*a*, 107*b* which in turn embrace the trunnions 105*a*, 105*b*. The outer peripheral surfaces 108*a*'', 108*b*'' fit in bores formed in the housing 109. These eccentric flanges 108*a*, 108*b* are fixed to the housing 109 by means of bolts 112 which pass through elongated holes 115 formed in the eccentric flanges.

Referring specifically to FIG. 6, tightening of the nut 111 on the threaded rod 100 causes the latter to move upward, with the result that the pivotable member 105 pivots counterclockwise about the axis of the trunnions 105*a*, 105*b*. Therefore, the first roll 103 is shifted upward so as to increase the gap between both rolls. Conversely, loosening of the nut 111 causes the gap between the rolls to be decreased. It is thus possible to suitably control the gap between these rolls in accordance with the thickness of the sheet material to be fed. If the eccentric flange 108*a* is rotated after loosening the bolts 112, the trunnion 105*a* is swung about a fulcrum on the trunnion 105*b* such that the trunnion 105*a* is moved in the directions perpendicular to the plane of FIG. 5. In consequence, the pivotable member 105 together with the first roll 103 is tilted such that the upper side thereof as viewed in FIG. 5 is moved in the directions perpendicular to the plane of FIG. 5. Similarly, when the other eccentric flange 108*b* is rotated, the pivotable member 105 and the first roll 103 as a unit are tilted such that the lower portion thereof as viewed in FIG. 5 is moved in the directions perpendicular to the plane of FIG. 5. It is thus possible to suitably vary and adjust the gap between both rolls along the axes of these rolls, for example, in the direction of breadth of the sheet material, thereby optimizing the state of contact between both rolls and the sheet material.

This known roll feed apparatus has the following drawback. As explained above, when one of the eccentric flange, for example, the eccentric flange 108*a*, is rotated, the first roll 103 is adjusted such that its end adjacent to the rotated eccentric flange is moved in the directions perpendicular to the plane of the sheet material, about a fulcrum which is supposed on the other end. For instance, the first roll 103 is swung from a position shown by solid line in FIG. 7 to a position shown by broken line in the same figure. In consequence, the mean value of the roll gap between the rolls as measured in the direction of axis of the roll, for example, the mean value of the distance between two rolls, is changed from G2 to Gl. Therefore, adjustment of the gap between two rolls through rotation of only one of the eccentric flanges has to be followed by a re-adjustment conducted by loosening or tightening the nut 111, in order to compensate for the variance G3 in the mean value of the roll gap. In some cases, both the eccentric flanges 108*a* and 108*b* are rotated through suitable angles so as to create a suitable profile of the gap between two rolls along the axes of these rolls. It is, however, difficult to effect such an adjustment without causing any change in the mean value of the gap.

Thus, the known roll feed apparatus essentially requires a complicated operation for optimizing the roll gap between two rolls.

SUMMARY OF THE INVENTION

Accordingly, an object of the present invention is to provide a roll feed apparatus which is capable of overcoming the above-described problems of the prior art.

To this end, according to the present invention, there is provided a roll feed apparatus comprising: a first roll fixedly carried by a first roll shaft which is on a first axis; a second roll fixedly carried by a second roll shaft which is on a second axis, the second roll being adapted for cooperating with the first roll in clamping a sheet material therebetween and feeding the sheet material; a turning shaft including a first shaft portion which is on a third axis and second shaft portions on both axial ends of the first shaft portion, the second shaft portions being on a fourth axis and rotatably supported by a housing through respective self-centering bearings; a pivotable member rotatably supporting portions of the first roll shaft on both sides of the first roll thus rotatably carrying the first roll, the pivotable member being pivotally supported by the first shaft portion of the turning shaft so as to pivot in such a manner as to move the first roll towards and away from the second roll; and operating means for causing the first shaft portion of the turning shaft to rotate relative to the pivotable member; the third axis extending substantially in parallel with the first axis at a position which is laterally spaced from the first roll, while the fourth axis extends such as to cross the third axis at a predetermined small angle, the point at which the third and fourth axes cross being positioned on or in the vicinity of a straight line which passes an axial mid-portion of the first roll and extends substantially perpendicular to the first axis.

DESCRIPTION OF THE PREFERRED EMBODIMENTS

Figure 1:
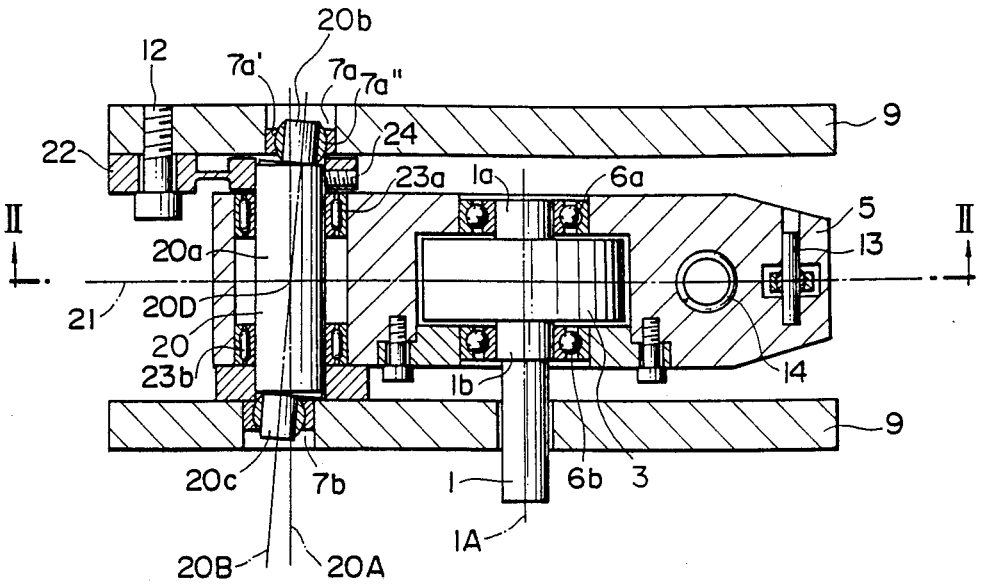
FIG. 1 is a sectional top plan view of an embodiment of the feed apparatus of the present invention.
Figure 2:
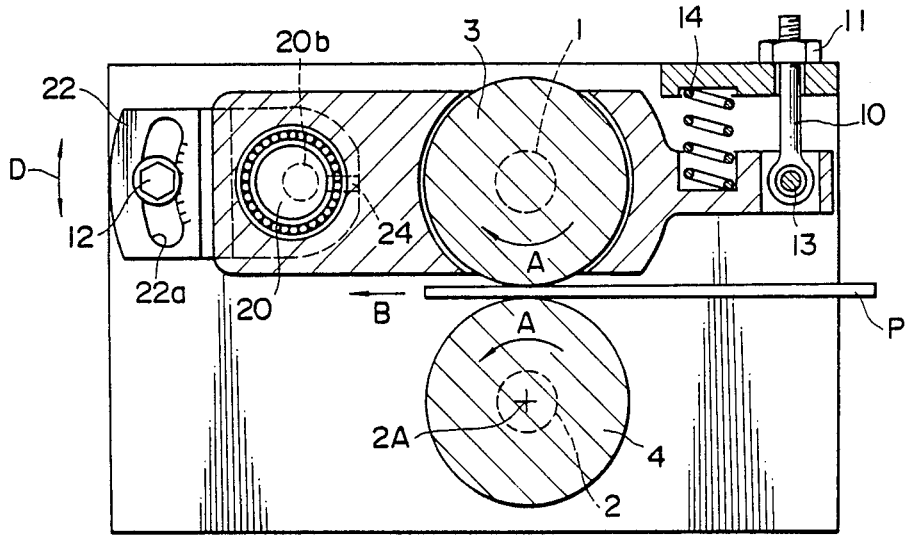
FIG. 2 is a sectional view taken along the line II—II of FIG. 1.

FIGS. 1 and 2 show an embodiment of the roll feed apparatus of the present invention. This roll feed apparatus has a first roll 3 fixedly carried by a first roll shaft 1 on a first axis 1A, and a second roll 4 fixedly carried by a second roll shaft 2 having an axis 2A parallel to the first axis 1A and rotatably supported at its both axial ends by a housing 9. In operation, both rolls 3 and 4 are intermittently rotated uni-directionally as indicated by arrows A so that a sheet material pinched between these rolls is fed in a direction B through a predetermined length. The mechanism for intermittently driving both rolls 3,4 in the directions of arrows A, for example, the mechanism for repeating driving of the rolls through a predetermined angle with a predetermined period of pause between successive rotation, is not described because such a mechanism is well known.

The first roll shaft 1 is rotatably supported at its portions 1*a*, 1*b* on both sides of the first roll 3 by a pivotable member 5 through respective bearings 6*a* and 6*b*. In other words, the pivotable member 5 holds the first roll 3 such that the portions 1*a*, 1*b* of the first roll shaft 1 are rotatably supported by the bearings 6*a*, 6*b*. The pivotable member 5 is pivotably supported at its left end by a turning shaft 20. As will be seen from FIGS. 1 and 3, the turning shaft 20 has a first shaft portion 20*a* which is on a third axis 20A, and second shaft portions 20*b* and 20*c* which are on a fourth axis 20B and provided on both axial ends of the first shaft portion 20*a*. The second shaft portions 20*b* and 20*c* are rotatably supported by the housing 9 through self-centering bearings 7*a* and 7*b*, respectively. The pivotable member 5 rotatably fits on the first shaft portion 20*a* of the turning shaft 20 through bearings 23*a* and 23*b*. The self-centering bearing 7*a* has an outer ring 7*a*′ the outer peripheral surface of which fits in a bore formed in the housing 9 and an inner ring 7*a*″ having an inner peripheral surface which fits on the second shaft portion 20*b*. The outer ring 7*a*′ has a spherically concaved inner surface which embraces a spherically convexed outer surface of the inner ring 7*a*″. The other self-centering bearing 7b has a construction which is substantially the same as that of the self-centering bearing 7*a*. The turning shaft 20 is adapted to be rotated by an operating means constituted by an operation lever 22 which is fixed at its right end to the first shaft portion 20*a*. The left end of the operation lever 22 is fixed to the housing 9 by means of a bolt 12 which extends through an elongated hole 22*a* formed in the operation lever 22. As will be seen from FIGS. 1 and 2, the operation lever 22 is fixed at its right end to the first shaft portion 20*a* of the turning shaft 20 by means of a bolt 24.

Figure 3:
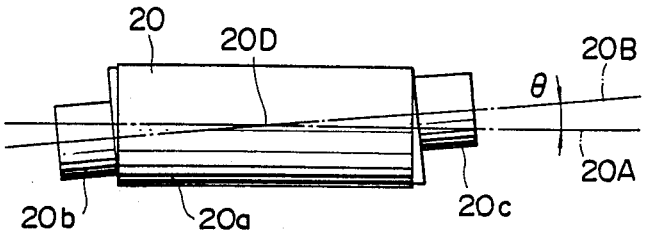
FIG. 3 is an enlarged view of a turning shaft incorporated in the roll feed apparatus shown in FIG. 2.

Referring now to FIG. 3, as well as to FIG. 1, the third axis 20A extends substantially in parallel with the first axis 1A at a position which is spaced laterally (to the left as viewed in FIG. 1) from the first roll 3. At the same time, the fourth axis 20B extends such as to cross the third axis 20A at a small angle $\theta$. The point 20D at which the third axis 20A and the fourth axis 20B cross each other is positioned on or in the vicinity of a straight line 21 which extends orthogonally to the first axis 1A and which passes breadthwise center, that is an axial mid portion, of the first roll 3.

Figure 5:
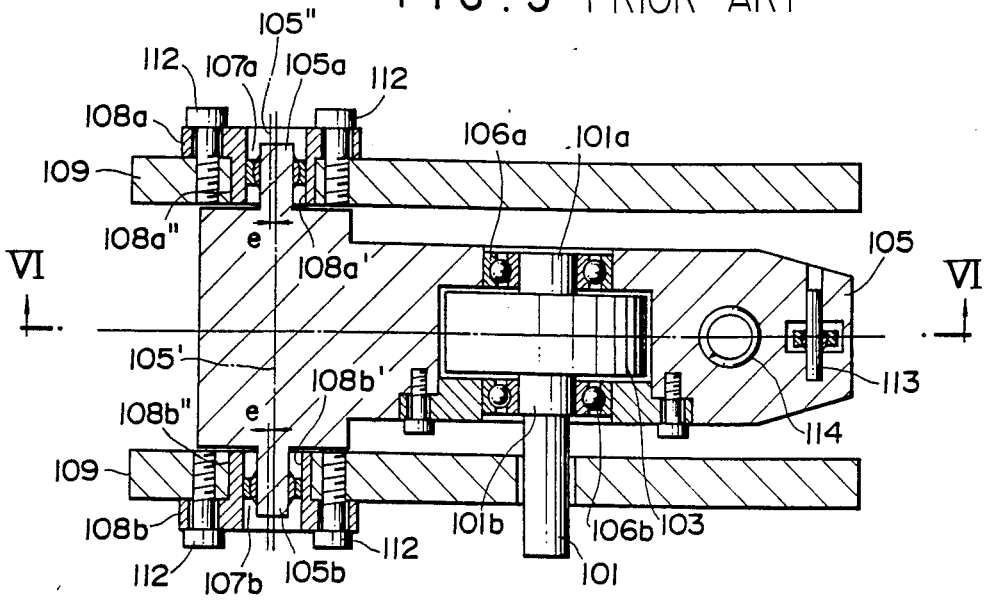
FIG. 5 PRIOR ART
FIG. 5 is a sectional top plan view of a known roll feed apparatus.
Figure 6:
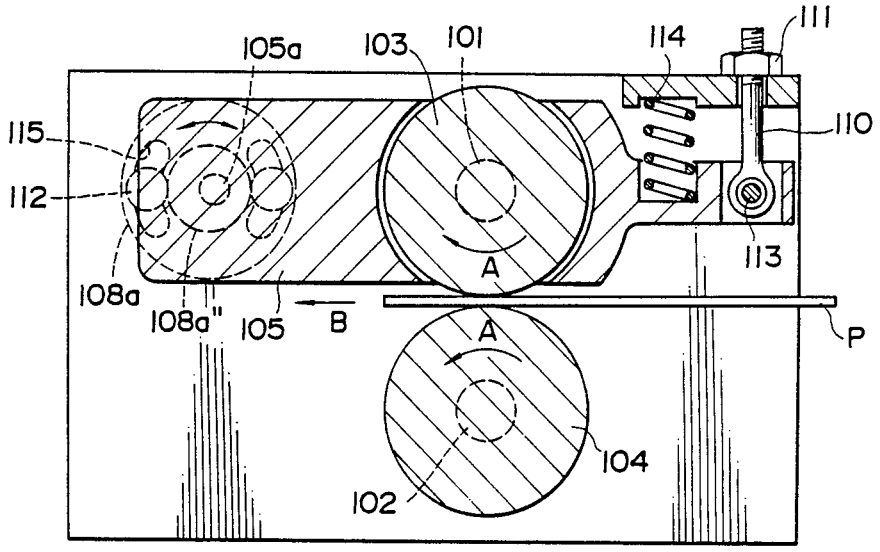
FIG. 6 PRIOR ART
FIG. 6 is a sectional view taken along the line IV—IV of FIG. 5.

As in the case of the known device which is shown in FIGS. 5 and 6, a threaded rod 10 is rotatably connected to the free right end of the pivotable member 5 through a pin 13, and a nut 11 is screwed to the end of the threaded rod. The right end of the pivotable member 5 is normally urged downward by a spring 14.

Tightening of the nut 11 in the state shown in FIG. 2 causes the threaded rod 10 to move upward to that the pivotable member 5 pivots counterclockwise about the first shaft portion 20*a* of the turning shaft 20. As a result, the first roll 3 moves upward to increase the distance between both rolls. Conversely, loosening of the nut 11 causes the roll gap to be decreased. It is thus possible to optimize the roll gap between both rolls in accordance with the thickness of the sheet material to be fed.

Figure 4:
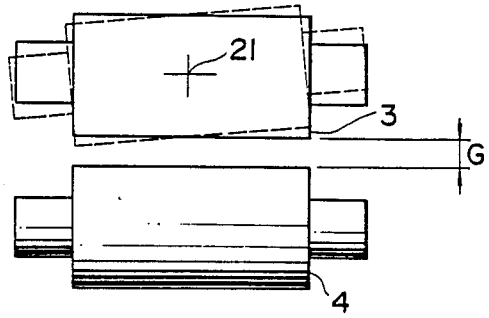
FIG. 4 is an illustration of the state of movement of a first roll caused by rotation of the turning shaft shown in FIG. 1.
Figure 7:
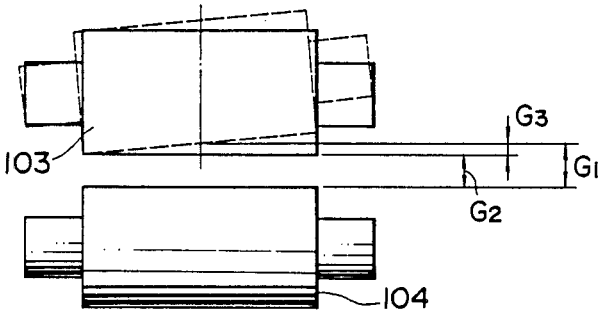
FIG. 7 PRIOR ART
FIG. 7 is an illustration of the state of movement of a first roll caused by rotation of the turning shaft shown in FIG. 1.

As explained before, the third axis 20A and the fourth axis 20B intersect each other at a small angle $\theta$. Therefore, when the operation lever 22 is rotated in the direction of an arrow D after loosening of the bolt 12, the turning shaft 20 revolves with respect to the pivotable member 5 and the housing 9, with the end of the first shaft portion 20*a* adjacent to one 20*b* of the second shaft portions moved upward relative to the plane of the sheet material, while the end thereof adjacent to the other 20*c* of the second shaft portions is moved downward relative to the plane of the sheet material, or vice versa. In consequence, the upper portion of the pivotable member 5 as viewed in FIG. 1 is moved upward relative to the plane of the sheet material, while the lower portion of the pivotable member 5 as viewed in FIG. 1 is moved downward relative to the plane of the sheet material or vice versa. It is thus possible to adjust the roll gap with a desired variation along the roll axes, for example, in the direction of breadth of the sheet material P and to fix the pivotable member 5 and the first roll 3 such as to maintain the adjusted roll gap, simply by rotating the operation lever 22 and then tightening the bolts 12. As explained before, the point 20D where the third axis 20A and the fourth axis 20B cross each other is located on or in the vicinity of the straight line 21. Therefore, the mean value of the distance between two rolls along the roll axes is not substantially changed by the above-mentioned adjustment. More specifically, when the operation lever 22 is swung, the first roll 3 is moved in such a manner that it oscillates about a point in the vicinity of the straight line 21 which passes the axial mid portion of the first roll 3, from the position shown by solid line in FIG. 4 to the position shown by broken line in the same figure. Consequently, the mean value G of the roll gap is maintained substantially unchanged. This feature advantageously eliminates the necessity for any readjustment for regulating the mean value of the roll gap after the adjustment of the roll gap through the swinging of the operation lever 22.

As will be understood from the foregoing description, the present invention offers an advantage in that the gap between the first roll and the second roll of a roll feed apparatus can be adjusted along the roll axes, for example, in the direction of breadth of the sheet material in accordance with the thickness of the sheet material to the rolled, simply by turning the tuning shaft by means of the operation means. In addition, this adjustment can be accomplished without causing substantial change in the mean value of the gap between two rolls.

What is claimed is:

1. A roll feed apparatus comprising:

a first roll fixedly carried by a first roll shaft which is on a first axis;

a second roll fixedly carried by a second roll shaft which is on a second axis, said second roll cooperating with said first roll in clamping a sheet material therebetween and feeding said sheet material;

a turning shaft including a first shaft portion which is on a third axis and second shaft portions on both axial ends of said first shaft portion, said second shaft portions being on a fourth axis and rotatably supported by a housing through respective self-centering bearings;

a pivotable member rotatably supporting portions of said first roll shaft on both sides of said first roll thus rotatably carrying said first roll, said pivotable member being pivotally supported by said first shaft portion of said turning shaft so as to pivot in such a manner as to move said first roll towards and away from said second roll; and operating means for causing said first shaft portion of said turning shaft to rotate relative to said pivotable member;

said third axis extending substantially in parallel with said first axis at a position which is laterally spaced from said first roll, while said fourth axis extends such as to cross said third axis at a predetermined small angle, the point at which said third and fourth axes cross being positioned on or on the vicinity of a straight line which passes an axial mid-portion of said first roll and extends substantially perpendicular to said first axis.

* * * * *